US008511243B2

(12) United States Patent
Gonzalez et al.

(10) Patent No.: US 8,511,243 B2
(45) Date of Patent: Aug. 20, 2013

(54) SEWING MACHINE AND A METHOD OF OPERATION

(75) Inventors: Jacinto Gonzalez, Juarez (MX); Paul S. Severinski, Brownstown, MI (US); Thomas A. Welch, Ortonville, MI (US); Oscar Fernando Dominguez, Juarez (MX); Michael U. Alvarez, Juarez (MX); Noe Cepeda Santos, Juarez (MX)

(73) Assignee: Lear Corporation, Southfield, MI (US)

( * ) Notice: Subject to any disclaimer, the term of this patent is extended or adjusted under 35 U.S.C. 154(b) by 560 days.

(21) Appl. No.: 12/750,867

(22) Filed: Mar. 31, 2010

(65) Prior Publication Data

US 2011/0239922 A1 Oct. 6, 2011

(51) Int. Cl.
*D05B 19/00* (2006.01)

(52) U.S. Cl.
USPC ..... 112/470.03

(58) Field of Classification Search
USPC ..... 112/475.03, 475.06, 315, 316, 317, 112/475.04, 475.02, 475.25
See application file for complete search history.

(56) References Cited

U.S. PATENT DOCUMENTS

| | | | | |
|---|---|---|---|---|
| 4,171,671 | A * | 10/1979 | Welcher et al. | 112/470.04 |
| 4,694,762 | A | 9/1987 | Takano et al. | |
| 5,178,080 | A * | 1/1993 | Nomura et al. | 112/470.06 |
| 5,222,451 | A * | 6/1993 | Akahane et al. | 112/475.03 |
| 6,032,595 | A * | 3/2000 | Okuyama | 112/102.5 |
| 6,308,647 | B1 | 10/2001 | Okabe et al. | |
| 6,792,883 | B2 * | 9/2004 | Ashton | 112/475.01 |
| 7,412,936 | B2 | 8/2008 | Price et al. | |
| 7,461,606 | B2 | 12/2008 | Ota et al. | |
| 2004/0060493 | A1 | 4/2004 | Ebata et al. | |
| 2007/0204779 | A1 | 9/2007 | Naka et al. | |
| 2008/0229991 | A1 | 9/2008 | Makino et al. | |
| 2009/0050038 | A1 | 2/2009 | Ishii et al. | |

FOREIGN PATENT DOCUMENTS

| | | | |
|---|---|---|---|
| CN | 1277275 | A | 12/2000 |
| CN | 1610774 | A | 4/2005 |

* cited by examiner

*Primary Examiner* — Tejash Patel
(74) *Attorney, Agent, or Firm* — Brooks Kushman P.C.

(57) ABSTRACT

A sewing machine having a bed, a first guide assembly, and a second guide assembly. The first and second guide assemblies are moveably disposed on the bed and spaced apart from each other. At least one of the first and second guide assemblies are actuated when a sensor detects that a workpiece is mispositioned.

20 Claims, 4 Drawing Sheets

Fig-3
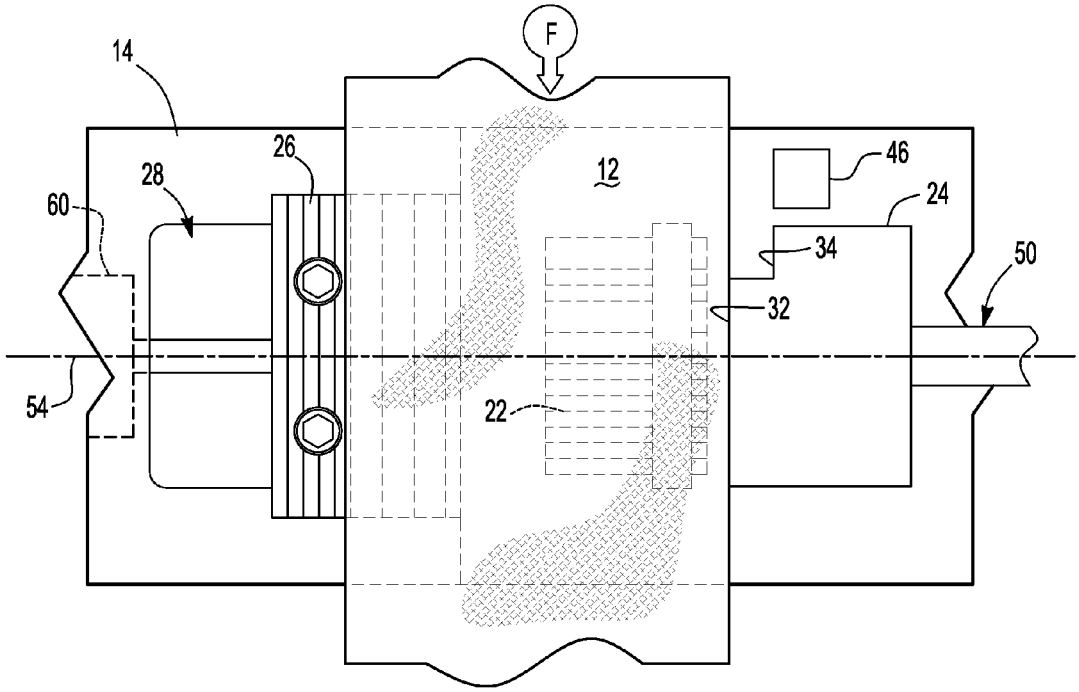
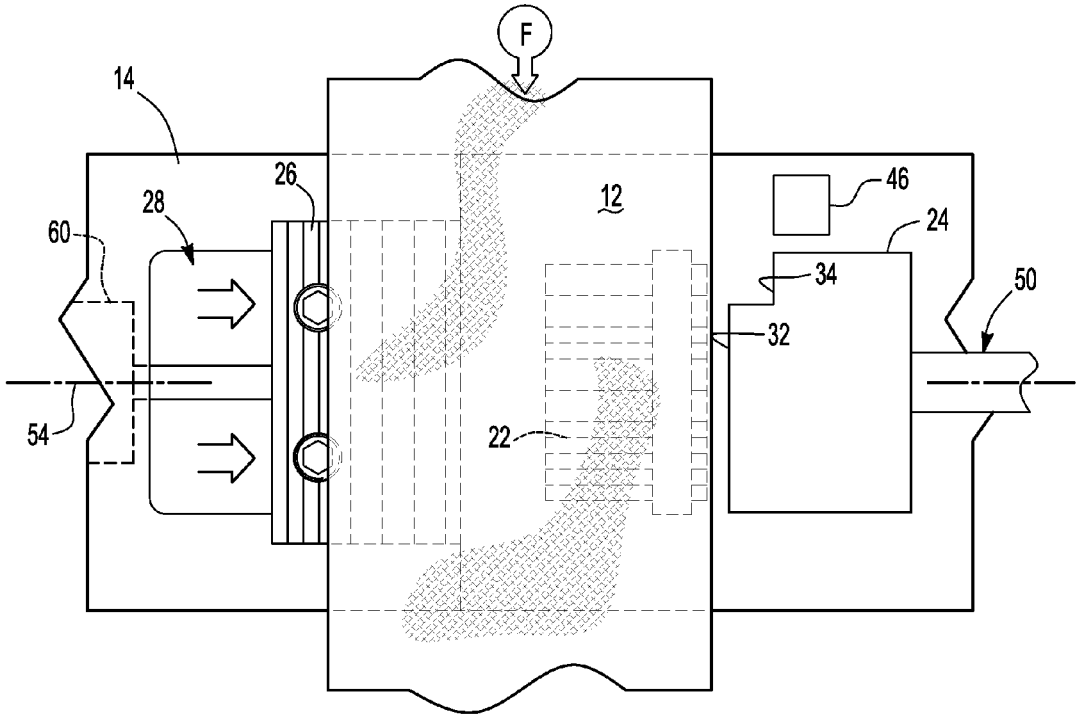
Fig-4

Fig-5
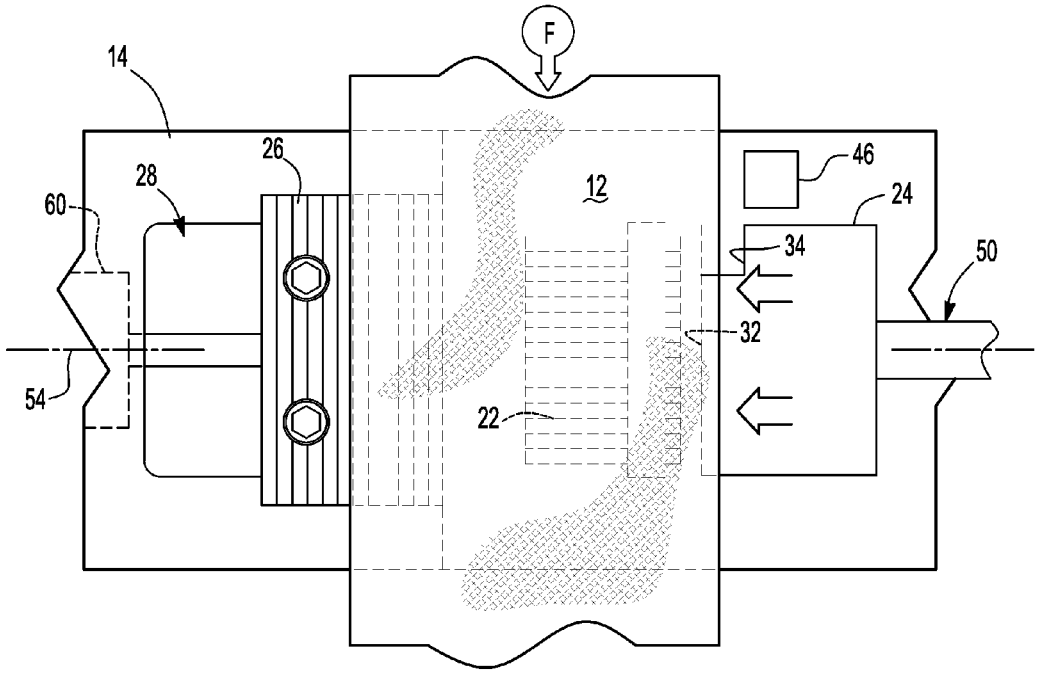
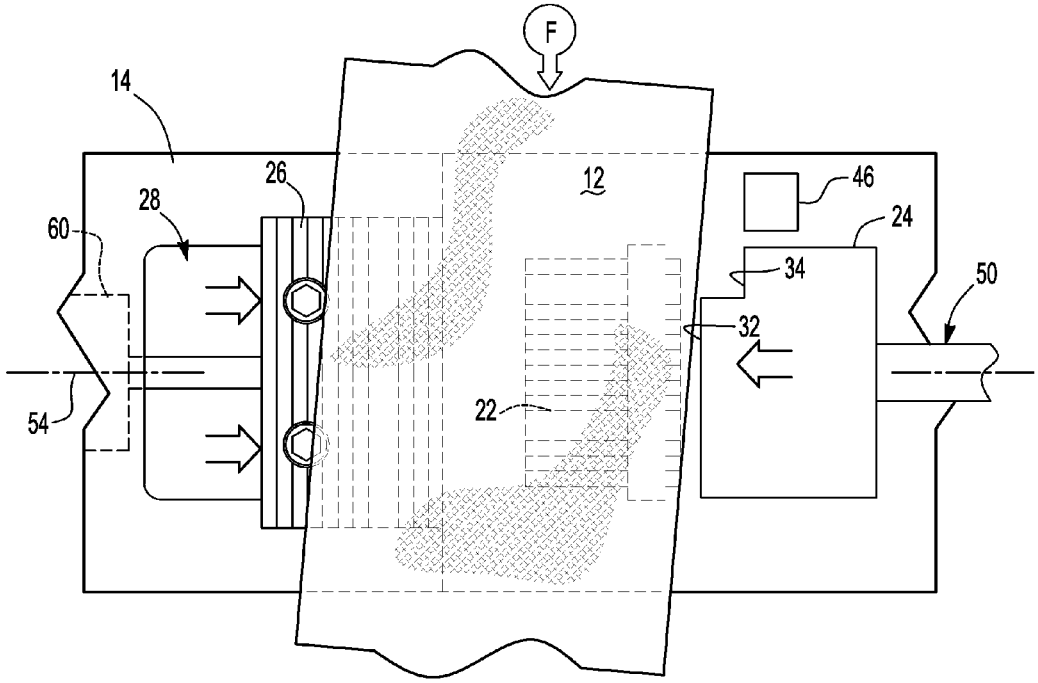
Fig-6

SEWING MACHINE AND A METHOD OF OPERATION

BACKGROUND OF THE INVENTION

Field of the Invention

The present invention relates to a sewing machine and a method of operation.

SUMMARY OF THE INVENTION

In at least one embodiment a sewing machine is provided. The sewing machine includes a bed and first and second guide assemblies moveably disposed on the bed. The first guide assembly has a sensor configured to detect a workpiece. The second guide assembly is spaced apart from the first guide assembly. At least one of the first and second guide assemblies are actuated when the sensor detects that the workpiece is mispositioned.

In at least one embodiment a sewing machine is provided. The sewing machine includes a stationary bed and first and second guide assemblies moveably disposed on the bed. The first guide assembly has first and second sensors that are configured to detect a workpiece and a first actuator for actuating the first guide assembly. The second guide assembly is spaced apart from the first guide assembly and has a second actuator for actuating the second guide assembly. The first and second guide assemblies are actuated when the first and second sensors detect that the workpiece is skewed.

In at least one embodiment a method of operation for a sewing machine is provided. The method includes detecting a workpiece with a sensor, determining whether the workpiece is mispositioned based on a signal from the sensor, and executing a correction strategy in which at least one of the first guide assembly and a second guide assembly are actuated to reposition the workpiece.

BRIEF DESCRIPTION OF THE DRAWINGS

FIG. 3 is a top view showing a workpiece in an aligned position on the sewing machine.

FIGS. 4-6 are top views showing the workpiece in exemplary misaligned positions on the sewing machine.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
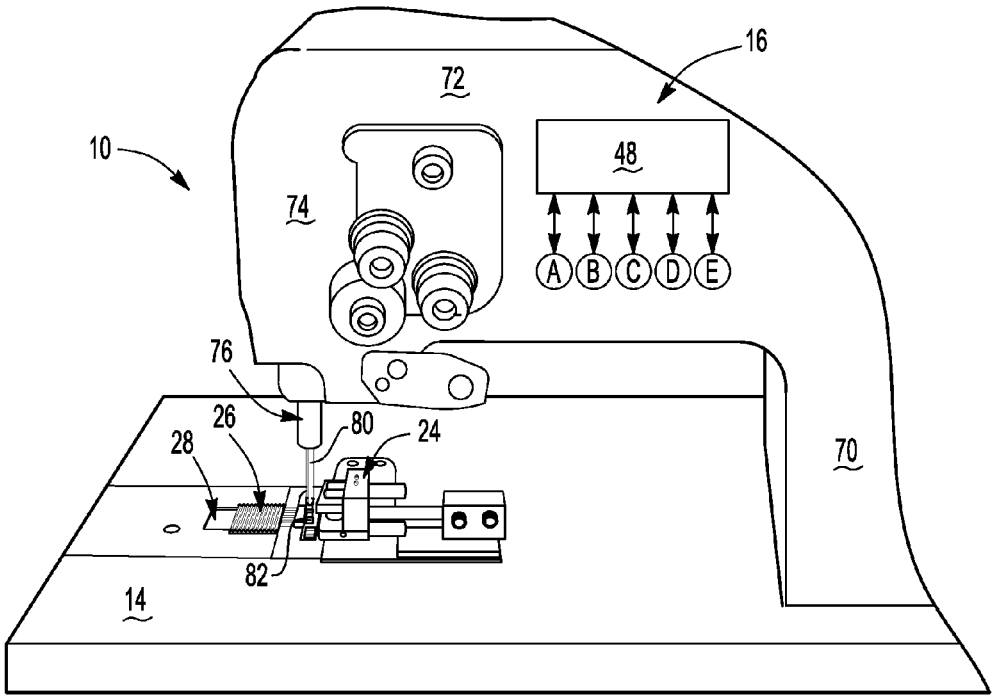
FIG. 1 is a perspective view of a sewing machine.
Figure 2:
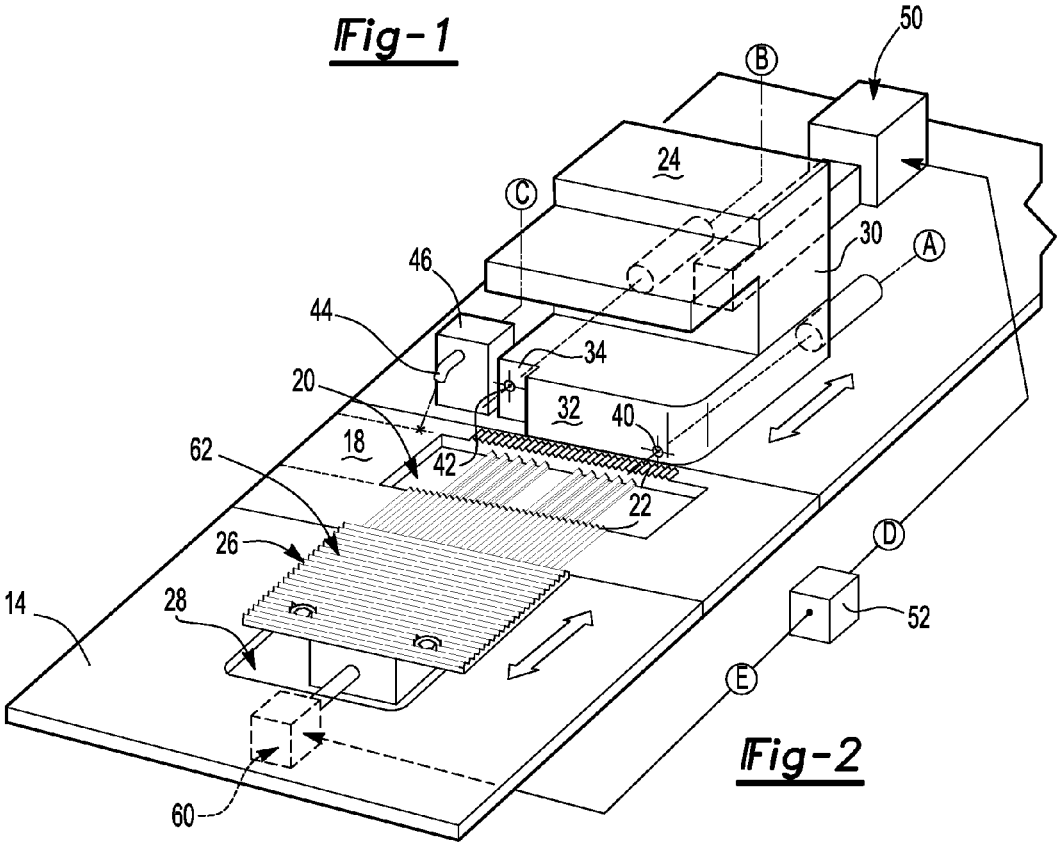
FIG. 2 is a perspective view of a bed of the sewing machine.

Referring to FIGS. 1-3, an exemplary sewing machine 10 is shown. The sewing machine 10 may be configured to sew or stitch a workpiece 12 having one or more pieces or layers. The workpiece 12 may be made of any suitable material or materials, such as fabric, leather, vinyl, or the like. The sewing machine 10 may include a bed 14 and an upper portion 16.

The bed 14 may be configured to support a workpiece 12 and may be stationary in one or more embodiments. The bed 14 may include a top surface 18 upon which a workpiece 12 may be positioned. As is best shown in FIG. 2, the bed 14 may include a first opening 20, a set of gripping features 22, a first guide assembly 24, a second guide assembly 26, and a second opening 28.

The opening 20 may be provided in the bed 14 to facilitate stitching of the workpiece 12. For example, the opening 20 may be provided as a rectangular opening or hole that receives a looper mechanism or a shuttle hook and bobbin assembly that engages a thread during stitching operations in a manner known by those skilled in the art.

The set of gripping features 22 may be provided adjacent to the opening 20 to facilitate engagement and positioning of the workpiece 12. In the embodiment shown in FIG. 2, the set of gripping features 22 are provided on opposite sides of the opening 20. Members of the set of gripping features 22 may have any suitable configuration. For instance, the gripping features may be configured as a plurality of protrusions and/or indentations that provide a textured or knurled surface for engaging the workpiece 12. The members of the set of gripping features 22 may be disposed substantially parallel to each other in one or more embodiments and may be arranged to extend in a direction that extends generally from the first guide assembly 24 toward the second guide assembly 26. The set of gripping features 22 may have any suitable cross section, such as a triangular cross section in one or more embodiments.

The first guide assembly 24 may be moveably disposed on the bed 14 and may be configured to facilitate positioning of the workpiece 12. For example, the first guide assembly 24 may be configured to move substantially perpendicular to a an exemplary feed direction of the workpiece 12, represented by arrow F in FIG. 3. The first guide assembly 24 may include a guide block 30 that extends from the top surface 18 of the bed 14. The guide block 30 may have a guide surface 32 that engages and aligns the workpiece 12. For instance, the guide surface 32 be substantially planar and may extend substantially perpendicular to the bed 14. The first guide assembly 24 may also include a secondary guide surface 34 that may be offset from the guide surface 32. For example, the secondary guide surface 34 may be recessed, set back, or disposed further away from the opening 20 in the bed 14 than the guide surface 32 in one or more embodiments.

The first guide assembly 24 may include a first sensor 40 and a second sensor 42. The first and second sensors 40, 42 may be configured to detect the presence and/or position of the workpiece 12. The first and second sensors 40, 42 may be of any suitable type, such as a light sensor (e.g., fiber optic, laser), proximity sensor, or vision system. The first and second sensors 40, 42 may also be spaced apart from each other and disposed at different distances from the bed 14. For example, the first sensor 40 may be disposed closer to the bed than the second sensor 42 in one or more embodiments. As such the first and second sensors 40, 42 may cooperate to detect the thickness of the workpiece 12. For instance, the second sensor 42 may detect when a workpiece 12 has sufficient thickness (e.g., has a suitable number of layers or is folded) and may be arranged to not detect the workpiece 12 when sufficient thickness is not provided. In at least one embodiment, the first sensor 40 may be disposed proximate the guide surface 32 while the second sensor 42 may be disposed proximate the secondary guide surface 34.

Optionally, a third sensor 44 may be provided that is configured to detect the presence and/or position of the workpiece 12. The third sensor 44 may be fixedly positioned with respect to the bed 14. For example, the third sensor 44 may be disposed on a stationary mounting block 46. The third sensor 44 may be a similar type of sensor as the first and/or second sensors 40, 42 and may be offset vertically and/or horizontally from the first and second sensors 40, 42.

The first, second, and third sensors 40, 42, 44 may be electrically connected to or in communication with a controller 48. The controller 48 may be of any suitable type, such as a programmable logic controller (PLC). The connections or communication between the first, second, and third sensors 40, 42, 44 and the controller 48 are represented by connection points A, B, and C, respectively, in FIGS. 1 and 2. The controller 48 may be used to monitor and control various characteristics of the sewing machine 10. For example, the controller 48 may process inputs from various components, such as the first, second, and/or third sensors 40, 42, 44 and provide output commands or signals to control the operation of sewing machine components.

The first guide assembly 24 may include a first actuator assembly 50 that actuates the first guide assembly 24 with respect to the bed 14. The first actuator assembly 50 may have any suitable configuration, such as a linear actuator like a pneumatic cylinder that may be selectively fluidly connected to a pressurized gas source 52. The first actuator assembly 50 may be mounted to the bed 14 in any suitable position, such as on the top surface 18 of the bed 14. The first actuator assembly 50 may move the first guide assembly 24 toward or away from the second guide assembly 26 as represented by the arrows in FIG. 2. In addition, operation of the first actuator assembly 50 may be controlled by the controller 48 as represented by connection point D, which may control operation of a solenoid or valve that may control fluid flow from the pressurized gas source 52.

The second guide assembly 26 may be moveably disposed on the bed 14. For example, the second guide assembly 26 may be configured to move in a direction of travel that may be substantially perpendicular to the exemplary feed direction F of the workpiece 12. The second guide assembly 26 may include a second actuator assembly 60 that actuates the second guide assembly 26 with respect to the bed 14. The second actuator assembly 60 may have any suitable configuration, such as a linear actuator like a pneumatic cylinder that may be selectively fluidly connected to the pressurized gas source 52. The second actuator assembly 60 may be mounted to the bed 14 in any suitable position. In the embodiment shown, the second actuator assembly 60 is disposed proximate a bottom surface of the bed 14. The second actuator assembly 60 may move the second guide assembly 26 toward or away from the first guide assembly 24 as represented by the arrows in FIG. 2. The first and second guide assemblies 24, 26 may be actuated independently or in unison in one or more embodiments. In addition, operation of the second actuator assembly 60 may be controlled by the controller 48 as represented by connection point E, which may control operation of a solenoid or valve that may control fluid flow from the pressurized gas source 52. In addition, the first and second actuator assemblies 50, 60, may be configured such that the first and second guide assemblies move along a common axis 54 as shown in FIG. 3.

A second set of gripping features 62 may be provided with the second guide assembly 26. Members of the second set of gripping features 62 may have any suitable configuration. For instance, the gripping features may be configured as a plurality of protrusions and/or indentations that may provide a textured or knurled surface for engaging the workpiece 12. The members of the second set of gripping features 62 may be disposed substantially parallel to each other in one or more embodiments and may be arranged to extend in a direction that extends generally parallel to the feed direction F or perpendicular to a direction of travel of the second guide assembly 26. The second set of gripping features 62 may have any suitable cross section, such as a triangular cross section in one or more embodiments.

The second opening 28 may be provided in the bed 14. The second opening 28 may be at least partially disposed under the second guide assembly 26. The second opening 28 may provide access for connecting the second actuator assembly 60 to the second guide assembly 26. The second opening 28 may be narrower than the second guide assembly 26 such that opposing ends of the second guide assembly 26 may engage and slide along the bed 14.

The upper portion 16 may include a pillar 70 that is disposed proximate the bed 14. An arm 72 may extend from the pillar 70 and be spaced apart from the base 12. A head portion 74 may be disposed proximate an end of the arm 72 that may receive a needle bar assembly 76 and a presser foot (not shown). The needle bar assembly 76 may include a needle 80 for penetrating the workpiece 12 to be sewn and a needle bar 82 for securing the needle 80 thereto. The head portion 74 may receive a needle bar driver assembly that actuates the needle bar assembly 76 in an oscillating motion. The presser foot may exert downward pressure on the workpiece 12 as it is fed under the needle 80.

Referring to FIGS. 3-6, a sewing machine is shown with a workpiece 12 in various positions. In FIG. 3, the workpiece 12 is shown in an exemplary aligned position. In the exemplary aligned position, the workpiece 12 or an edge of the workpiece 12 may be aligned with the guide surface 32 of the guide block 30. For instance, an edge of the workpiece 12 may engage and be disposed substantially parallel to the guide surface 32.

In FIGS. 4-6, a workpiece 12 is shown in various positions that differ from the exemplary aligned position shown in FIG. 3. In FIG. 4, the workpiece 12 is spaced apart from the guide surface 32 of the guide block 30 by more than a threshold amount but is not skewed with respect to the guide surface 32. The threshold amount may be established based on design parameters. For instance, the threshold amount may be more than 2 mm in one or more embodiments. In FIG. 5, the workpiece 12 overlaps the guide surface 32 of the guide block 30 and is therefore located too close to the guide block 30. In FIG. 6, the workpiece 12 is skewed with respect to the guide surface 32 of the guide block 30 such that the workpiece 12 is disposed at an angle with respect to a desired angular position. The workpiece 12 may also be skewed in the opposite direction with respect to the guide block 30 (e.g., in a counterclockwise direction from the perspective shown in FIG. 4).

Figure 7:
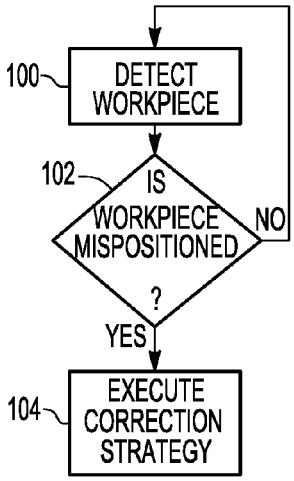
FIGS. 7 and 8 are flowcharts depicting exemplary methods of operation that may be associated with the sewing machine.
Figure 8:
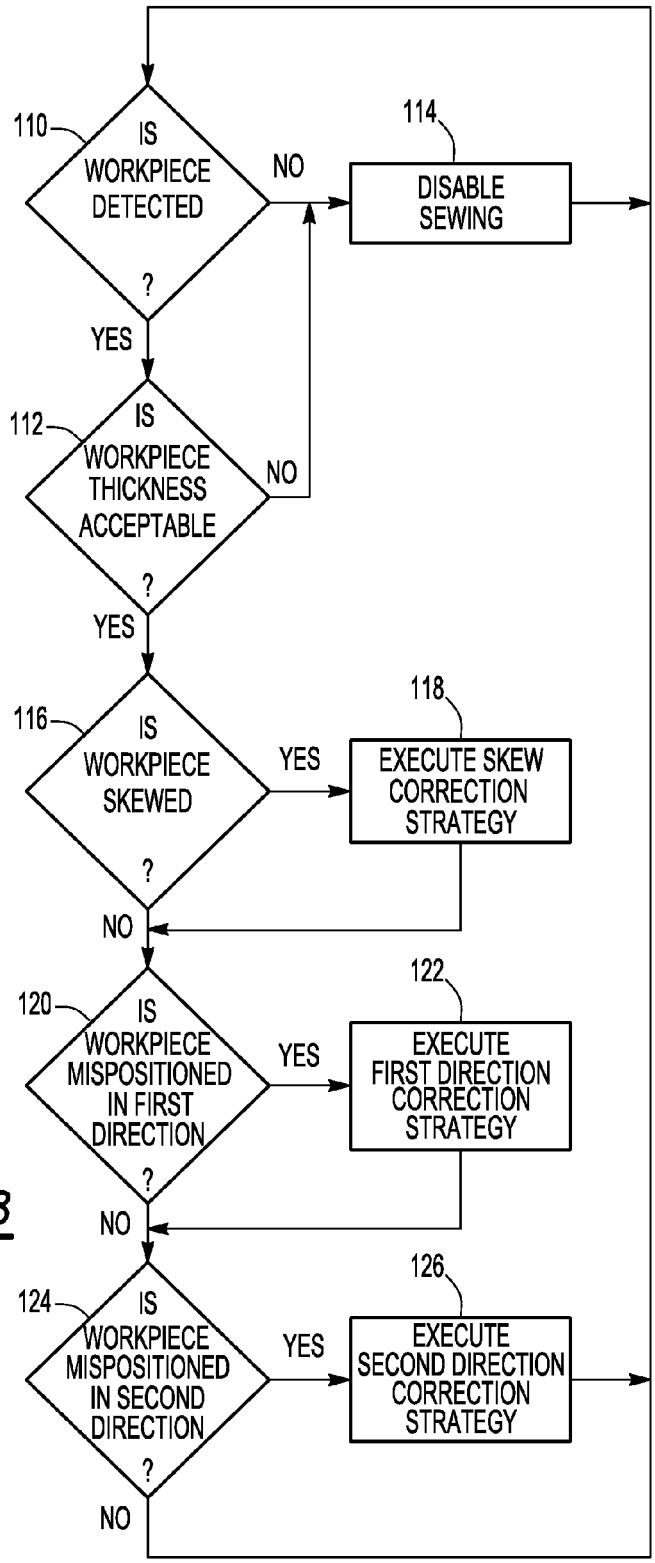

Referring to FIGS. 7 and 8, flowcharts depicting exemplary methods of controlling and operating a sewing machine is shown. The methods may assess and correct the position of the workpiece 12. The workpiece 12 may be mispositioned in the positions shown in FIGS. 4-6 and may be correctly positioned in the position shown in FIG. 3.

As will be appreciated by one of ordinary skill in the art, the flowcharts may represent control logic that may be implemented or affected in hardware, software, or a combination of hardware and software. For example, the various functions may be effected by a programmed microprocessor. The control logic may be implemented using any of a number of known programming and processing techniques or strategies and is not limited to the order or sequence illustrated. For instance, interrupt or event-driven processing is typically employed in real-time control applications rather than a purely sequential strategy as illustrated. Likewise, parallel processing, multitasking, or multi-threaded systems and methods may be used to accomplish the objectives, features, and advantages of the present invention. The implementation of the method is independent of the particular programming language, operating system, processor, or circuitry used to develop and/or implement the control logic illustrated. Likewise, depending upon the particular programming language and processing strategy, various functions may be performed in the sequence illustrated, at substantially the same time, or in a different sequence while accomplishing the features and advantages of the present invention. The illustrated functions may be modified, or in some cases omitted, without departing from the spirit or scope of the present invention.

The flowchart in FIG. 7 provides an overview of an exemplary method of control. At block 100, the method begins when a workpiece 12 is detected. If a workpiece 12 is detected, the method continues at block 102.

At block 102, the method determines whether the workpiece 12 is mispositioned. If the workpiece 12 is not mispositioned, sewing operations may be enabled and a workpiece positioning correction strategy is not enabled. If the workpiece 12 is mispositioned, the method continues at block 104.

At block 104, one or more correction strategies are executed to correct the position of the workpiece 12. The correction strategies may address improper lateral positioning of the workpiece 12, skewing of the workpiece 12, or combinations thereof.

Referring to FIG. 8, another exemplary method of control is shown. This method provides more detailed method steps that may be implemented as part of a control strategy.

At block 110, the method begins by determining whether a workpiece is detected. The workpiece 12 may be detected by the first, second, and/or third sensors 40, 42, 44 or combinations thereof in various embodiments. If a workpiece 12 is detected, the method continues at block 112. In addition, the position of the first and second guide assemblies 24, 26 may be moved to initialization positions. If a workpiece 12 is not detected, then the method continues at block 114 where sewing operation steps may be disabled due to the absence of a workpiece 12 that may receive stitching.

At block 112, the method determines whether the detected workpiece has an acceptable thickness. The thickness of the workpiece 12 may be detected by the first, second, and/or third sensors 40, 42, 44 or combinations thereof. In at least one embodiment, the workpiece thickness may be acceptable when the workpiece 12 is detected by at least the second sensor 42 when the second sensor 42 is positioned further from the bed 14 than the first sensor 40. As such, the second sensor 42 may detect whether the workpiece 12 is sufficiently thick or whether multiple layers of material have been provided that are to be sewn together. If the workpiece 12 thickness is acceptable, then the method continues at block 116. If the workpiece 12 thickness is not acceptable, then the method continues at block 114 where sewing operation steps may be disabled due to the absence of a workpiece 12 having an acceptable thickness.

At block 116, the method determines whether the workpiece is skewed or disposed at an undesired angle relative to the guide block 30 and/or the guide surface 32. An undesired angle may be an angle in excess of established design parameters. For example, the workpiece 12 may be skewed if it is not substantially parallel to or within a predetermined angular orientation range with respect to the guide block 30 and/or the guide surface 32. A skewed workpiece 12 may be detected by the first, second and/or third sensors 40, 42, 44. For example, the first sensor 40 may detect the workpiece 12 while the second sensor 42 may not detect the workpiece 12 if the workpiece 12 is skewed or vice versa. The amount of skew detected by the sensors may be based on the characteristics and/or positioning of the sensors. For instance, a smaller amount of skew may be detected by spacing the sensors further apart. If the workpiece 12 is skewed, then the method continues at block 118. If the workpiece 12 is not skewed, then the method continues at block 120.

At block 118, a skew correction strategy is executed. The skew correction strategy may actuate the first and second guide assemblies 24, 26 to reduce or correct the skew of the workpiece 12. In at least one embodiment, the inventors have realized that skew may be effectively corrected by actuating the first and second guide assemblies 24, 26 toward each other as represented by the arrows in FIG. 6. The actuation distance of the first and second guide assemblies 24, 26 may be the same or different amounts.

At block 120, the method determines whether the workpiece is mispositioned in a first direction. The first direction may be a lateral direction or distance from the guide block 30 and/or the guide surface 32, such as is shown in FIG. 4. Mispositioning in the first direction may exist when the workpiece 12 is located at an undesired distance from the guide block 30 and/or the guide surface 32 that exceeds established design parameters. Mispositioning of the workpiece 12 may be detected by the first, second, and/or third sensors 40, 42, 44. For example, the first, second, and/or third sensors 40, 42, 44 may detect that the workpiece 12 is located more than a predetermined distance from the guide block 30 or guide surface 32. Alternatively, mispositioning of the workpiece 12 in the second direction may be detected by one sensor, such as the second or third sensor 42, 44. If the workpiece 12 is mispositioned in the first direction, then the method continues at block 122. If the workpiece 12 is not mispositioned in the first direction, then the method continues at block 124.

At block 122, a first direction correction strategy is executed. The first direction correction strategy may actuate the first and/or second guide assemblies 24, 26 to reduce or correct the lateral positioning of the workpiece 12. Lateral positioning may be corrected by actuating the second guide assembly 26 toward the first guide assembly 24 as represented by the arrows in FIG. 4. The first guide assembly 24 may be maintained in a stationary position while the second guide assembly 26 is actuated. The actuation distance of the second guide assembly 26 may be predetermined and based on parameters stored in a lookup table. For instance, a set of actuation distances corresponding to various lateral workpiece 12 positions may be stored in a lookup table and implemented based on positioning data from one or more sensors. Alternatively, actuation of the second guide assembly 26 may occur until the first, second, and/or third sensors 40, 42, 44 detect that the workpiece 12 has moved to a desired position.

At block 124, the method determines whether the workpiece is mispositioned in a second direction that differs from the first direction. The second direction may be a lateral direction or distance from the guide block 30 and/or the guide surface 32, such as is shown in FIG. 5. Mispositioning in the second direction may exist when the workpiece 12 is located at an undesired distance that is too close to the guide block 30 and/or the guide surface 32 that exceeds established design parameters. Mispositioning of the workpiece 12 may be detected by the first, second, and/or third sensors 40, 42, 44. For example, the first, second, and/or third sensors 40, 42, 44 may detect that the workpiece 12 is located less than a predetermined distance from the guide block 30 or guide surface 32. Alternatively, mispositioning of the workpiece 12 in the second direction may be detected by one sensor, such as the second or third sensors 42, 44. If the workpiece 12 is mispositioned in the second direction, then the method continues at block 126. If the workpiece 12 is not mispositioned in the second direction, then the method may end or return to an earlier method step, such as block 110.

At block 126, a second direction correction strategy is executed. The second direction correction strategy may actuate the first and/or second guide assemblies 24, 26 to correct the lateral positioning of the workpiece 12. Lateral positioning may be corrected by actuating the first guide assembly 24 toward the second guide assembly 26 as is represented by the arrows in FIG. 5. The second guide assembly 26 may be maintained in a stationary position while the first guide assembly 24 is actuated. The actuation distance of the first guide assembly 24 may be predetermined and based on parameters stored in a lookup table. For instance, a set of actuation distances corresponding to various lateral workpiece 12 positions may be stored in a lookup table and implemented based on positioning data from one or more sensors. Alternatively, actuation of the first guide assembly 24 may occur until the first, second, and/or third sensors 40, 42, 44 detect that the workpiece 12 has moved to a desired position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A sewing machine comprising:

a bed;

a first guide assembly moveably disposed on the bed and having a sensor configured to detect a workpiece; and a second guide assembly spaced apart from the first guide assembly and moveably disposed on the bed;

wherein at least one of the first and second guide assemblies are actuated when the sensor detects that the workpiece is mispositioned.

2. The sewing machine of claim 1 wherein the second guide assembly includes a set of gripping features that extend substantially perpendicular to a direction of travel of the second guide assembly.

3. The sewing machine of claim 1 wherein the second guide assembly includes a set of gripping features and the bed includes a second set of gripping features that extend substantially perpendicular to the set of gripping features.

4. The sewing machine of claim 1 wherein the first and second guide assemblies are configured to slide along a top surface of the bed.

5. The sewing machine of claim 1 wherein the first and second guide assemblies are configured to move along a common axis.

6. A sewing machine comprising:

a stationary bed;

a first guide assembly moveably disposed on the bed, the first guide assembly including first and second sensors that are configured to detect a workpiece and a first actuator for actuating the first guide assembly; and a second guide assembly spaced apart from the first guide assembly and moveably disposed on the bed, the second guide assembly including a second actuator for actuating the second guide assembly;

wherein the first and second guide assemblies are actuated when the first and second sensors detect that the workpiece is mispositioned.

7. The sewing machine of claim 6 wherein the first sensor is disposed closer to the bed than the second sensor.

8. The sewing machine of claim 6 further comprising a needle bar assembly, wherein the first and second sensors are disposed on opposite sides of the needle bar assembly.

9. The sewing machine of claim 6 wherein the first guide assembly includes a guide surface that extends away from the bed, wherein the first sensor is disposed proximate the guide surface and the second sensor is spaced apart from the guide surface.

10. The sewing machine of claim 6 wherein the first and second guide assemblies are configured to move generally perpendicular to a feed direction of the workpiece.

11. The sewing machine of claim 6 wherein the bed further comprises an opening and the second guide assembly is at least partially disposed over the opening.

12. A method of operation for a sewing machine, comprising:

detecting a workpiece with a sensor;

determining whether the workpiece is mispositioned based on a signal from the sensor; and executing a correction strategy in which at least one of a first guide assembly and a second guide assembly are actuated to reposition the workpiece, wherein the first and second guide assemblies are moveably disposed on a bed and located on opposite sides of a first opening that is provided in the bed under a needle bar assembly.

13. The method of claim 12 wherein the step of detecting the workpiece further comprises determining whether a thickness of the workpiece is acceptable and disabling stitching operations if the thickness is not acceptable.

14. The method of claim 13 wherein the thickness of the workpiece is acceptable when the workpiece is detected by first and second sensors disposed on the first guide assembly, wherein the first and second sensors are positioned at different distances from the bed.

15. The method of claim 12 wherein the step of determining whether the workpiece is mispositioned includes determining whether the workpiece is skewed with respect to the first guide assembly and executing a skew correction strategy when the workpiece is skewed.

16. The method of claim 15 wherein the skew correction strategy includes actuating the first guide assembly and the second guide assembly toward each other.

17. The method of claim 12 wherein the step of determining whether the workpiece is mispositioned includes determining whether the workpiece is disposed too far from the first guide assembly and executing a first direction correction strategy when the workpiece is disposed too far from the first guide assembly.

18. The method of claim 17 wherein the first direction correction strategy includes actuating the second guide assembly toward the first guide assembly to move the workpiece toward the first guide assembly.

19. The method of claim 12 wherein the wherein the step of determining whether the workpiece is mispositioned includes determining whether the workpiece is disposed too close to the first guide assembly and executing a second direction correction strategy when the workpiece is disposed too close to the first guide assembly.

20. The method of claim 19 wherein the second direction correction strategy includes actuating the first guide assembly toward the second guide assembly to move the workpiece toward the second guide assembly.

* * * * *

UNITED STATES PATENT AND TRADEMARK OFFICE

CERTIFICATE OF CORRECTION

PATENT NO. : 8,511,243 B2
APPLICATION NO. : 12/750867
DATED : August 20, 2013
INVENTOR(S) : Jacinto Gonzalez It is certified that error appears in the above-identified patent and that said Letters Patent is hereby corrected as shown below:

In the Claims

Column 8, Line 60, Claim 19:

After "claim 12 wherein" delete "the wherein"

Signed and Sealed this
Eleventh Day of March, 2014

Michelle K. Lee

Michelle K. Lee
*Deputy Director of the United States Patent and Trademark Office*